US005820364A

United States Patent [19]

Hazard

[11] Patent Number: 5,820,364

[45] Date of Patent: Oct. 13, 1998

[54] REHEAT FURNACE APPARATUS AND METHOD OF USE

[75] Inventor: Kenneth W. Hazard, Brecksville, Ohio

[73] Assignee: Republic Engineered Systems, Massillon, Ohio

[21] Appl. No.: 688,981

[22] Filed: Jul. 31, 1996

[51] Int. Cl.[6] ..... F27B 9/00; F27D 3/00

[52] U.S. Cl. ..... 432/121; 432/122; 432/124; 432/126; 432/127

[58] Field of Search ..... 432/122, 123, 432/124, 125, 126, 127, 128, 121, 135, 136, 137, 141, 153

[56] References Cited

U.S. PATENT DOCUMENTS

| | | | |
|---|---|---|---|
| 291,454 | 1/1884 | Wolfe . | |
| 634,499 | 10/1899 | Hundley . | |
| 756,946 | 4/1904 | Edwards . | |
| 1,624,258 | 4/1927 | Lane . | |
| 2,307,413 | 1/1943 | Loux . | |
| 3,079,135 | 2/1963 | Buckholdt . | |
| 3,119,606 | 1/1964 | Suydam et al. . | |
| 3,154,298 | 10/1964 | Amadieu . | |
| 3,243,059 | 3/1966 | Kalberkamp . | |
| 3,304,210 | 2/1967 | Lofstrom | 432/126 |
| 3,375,941 | 4/1968 | Repper, Jr. . | |
| 3,456,774 | 7/1969 | Blickenderfer et al. . | |
| 3,567,003 | 3/1971 | Towne et al. . | |
| 4,025,298 | 5/1977 | Tokitsu | 432/122 |
| 4,029,215 | 6/1977 | Birdwell . | |
| 4,147,258 | 4/1979 | Kaplan . | |
| 4,270,655 | 6/1981 | Noe . | |
| 4,427,371 | 1/1984 | Unks | 432/127 |
| 4,522,297 | 6/1985 | Jaegers . | |
| 4,586,898 | 5/1986 | Orbeck | 432/122 |
| 4,658,954 | 4/1987 | Harlow . | |
| 4,936,771 | 6/1990 | Sidwell | 432/127 |
| 4,944,383 | 7/1990 | Petrachkoff . | |
| 5,266,027 | 11/1993 | Kuwayama | 432/246 |
| 5,529,486 | 6/1996 | Bricmont | 432/124 |

*Primary Examiner*—Teresa J. Walberg
*Assistant Examiner*—Jiping Lu
*Attorney, Agent, or Firm*—Watts, Hoffmann, Fisher & Heinke Co., L.P.A.

[57] ABSTRACT

A reheat furnace for reheating elongated metal workpieces includes an entrance end portion and an exit end portion opposite to the entrance end portion, and two side walls spaced apart from each other and extending between the entrance and exit end portions. A conveyor mechanism is provided to convey the workpieces from the entrance end portion to the exit end portion. The reheat furnace is constructed to have a buffer zone adapted to temporarily contain workpieces without applying direct heat to the workpieces and a heating zone adapted to apply direct heat to the workpieces.

15 Claims, 4 Drawing Sheets

REHEAT FURNACE APPARATUS AND METHOD OF USE

FIELD OF THE INVENTION

This invention concerns the field of reheat furnaces and more particularly to a reheat furnace apparatus and method for reheating steel blooms.

BACKGROUND OF THE INVENTION

In the process of hot rolling elongated steel billets and blooms having a substantially rectangular cross-section, blooms are usually reheated in a reheat furnace after being produced by a casting machine. The workpieces are reheated in the reheat furnace up to a temperature suitable for subsequent rolling that reduces them further. Examples of reheat furnaces are provided in the publication, *The Making, Shaping, and Treating of Steel*, Ninth Edition, Herbick and Held, pp. 667–674, (1971).

Reheat furnaces are either batch-type or continuous. In batch-type reheat furnaces the material remains on the hearth in a fixed position until it is heated to the rolling temperature. In continuous furnaces the workpieces are heated to the rolling temperature as they are moved through the furnace. Continuous furnaces include pusher-type, walking-beam type and rotary-hearth type furnaces.

Walking-beam type continuous reheat furnaces include an entrance end, an exit end opposite to the entrance end, and two side walls spaced apart from each other and extending between the entrance and exit ends. A feed conveyor having driven rollers is provided near the entrance end of the furnace and extends between the side walls. A charging mechanism near the entrance end of the furnace has charging carriers that travel into and out of the furnace to transfer workpieces from the feed conveyor to a walking-beam conveyor mechanism inside the furnace.

The charging mechanism has arms or carriers that engage the underside of a workpiece positioned on the feed conveyor. The entrance end of the furnace is opened and the carriers move the workpiece perpendicular from the feed conveyor through the open entrance end of the furnace onto the walking-beam mechanism in the furnace. The walking-beam mechanism transports the workpieces from the entrance end portion to the exit end portion through a heating area. The walking beam mechanism walks the blooms across the furnace and places them on a discharge conveyor located near the exit end of the furnace, which removes the blooms from the furnace.

One process includes a ladle metallurgical facility, a vacuum tank degasser, a continuous caster, a reheat furnace and a rolling mill. The reheat furnace is disposed along the process line downstream from the continuous caster and upstream from the rolling mill. The caster operation and the rolling mill operation are designed to operate at specific production rates. However, due to production problems at the rolling mill, the production rates of the caster and the rolling mill are not always concurrent.

In the event of emergencies in production, the production rate of the reheat furnace may have to be decreased to accommodate variations in production at the rolling mill. For example, if there is a rolling mill outage due to an equipment failure, loss of power at the rolling mill necessitating its shut-down, or when the roll spacings are adjusted at the rolling mill, production at the reheat furnace must be decreased or stopped. After the reheat furnace capacity is met, there is no available space in the reheat furnace to store the blooms and backlogs of blooms occur upstream of the reheat furnace. These bloom backlogs are undesirable because the blooms cool to ambient temperature if allowed to remain outside the reheat furnace for too long. This is inefficient in that it requires additional time and energy to heat these blooms again. Also, for some grades of steel this heat loss will result in poor metallurgical quality of the blooms and may even require them to be scrapped. A typical charging machine for a reheat furnace transfers the workpieces from the feed conveyor to the first position in the heating zone of the furnace, the heating zone having burners for applying direct heat to the workpieces.

SUMMARY OF THE INVENTION

The present invention relates to a reheat furnace for reheating blooms or other elongated workpieces, which overcomes the aforementioned problems of the prior art and provides additional advantages. The present reheat furnace overcomes the backlog problems of conventional reheat furnaces by having a built-in buffer zone that temporarily stores the workpieces in the event of shut-down of the rolling mill, during emergencies, or for metallurgical purposes. The workpieces will either be transferred beyond the buffer zone into the heating zone during normal operation or, in the event of a rolling mill outage, deposited into one of 8 locations in the buffer zone. Also, the arrangement of the reheat furnace and the charging mechanism results in low furnace heat loss.

In a preferred form, the reheat furnace for reheating elongated steel workpieces includes an entrance end portion and an exit end portion opposite to the entrance end portion, and two side walls between the entrance and exit end portions. The furnace also includes a roof and a bottom portion. A conveyor mechanism conveys the workpieces in a direction transverse to their length from the entrance end portion to the exit end portion. The furnace is constructed with a buffer zone having no heating devices, e.g., burners, located therein for applying direct heat to the workpieces. The furnace is also constructed with a heating zone having heating devices located therein that apply direct heat to the workpieces.

An in-furnace feed conveyor is provided to feed workpieces in a direction of their length into the furnace entrance end portion through an opening in the sidewall. A walking beam conveyor conveys the workpieces in a direction transverse to their length from the entrance end portion to the exit end portion. A charging mechanism at the entrance end portion of the furnace has carriers that transfer workpieces from the in-feed conveyor within the furnace to selected locations on the walking beam conveyor mechanism in the buffer zone and the heating zone. An in-furnace discharge conveyor is provided to discharge workpieces in a direction of their length from the furnace exit end portion through an opening in the sidewall.

The present reheat furnace does not suffer from conventional backlog problems. The reheat furnace of the invention is designed to have a longer length than conventional furnaces to provide a built-in buffer zone. The reheat furnace is designed with a buffer zone despite the inherent increased costs associated with constructing such a larger furnace. The present reheat furnace employs the buffer zone even though it may decrease production rates when used. The reheat furnace is designed with the buffer zone despite such considerations, because of the significant advantages the buffer zone presents in preventing production backlogs.

The furnace charging machine transfers a workpiece to any of several available locations in the buffer zone. These buffer zone locations comprise the first region of the furnace, downstream from the furnace entrance end portion. From each of these locations the workpieces will have different lengths and times of travel before reaching the furnace heating zone. The charging machine can bypass the buffer zone entirely during normal operation when there is no rolling mill outage. In addition, operation of the reheat furnace may be adjusted to accommodate a rolling mill problem anticipated to last for a particular length of time. Thus, not only can the reheat furnace of the invention accommodate backlogs once they occur, its process control system reacts to backlogs of a particular anticipated duration.

In its broader aspects, the invention is a mechanism for lifting and moving blooms within a furnace including a plurality of elongated carriers movable along a path at least a portion of which is within the furnace. The carriers are adapted to travel along the path between a location where they receive a bloom and a location in the heating zone where they deposit the bloom normally. The carriers are adapted to travel along the path to selected locations in the buffer zone. Actuators each vertically move the workpiece engaging end of an associated charging carrier. Stationary driving mechanisms are each adapted to drive an associated one of the carriers into and out of the interior of the furnace.

At least one of the feed mechanism and the discharge mechanism each comprises a conveyor having driven rollers within the reheat furnace for feeding workpieces in a direction of their length from one side wall toward the other. A wall at the entrance end portion extends between the side walls. The entrance wall has openings each corresponding to an associated charging carrier and having a size approximating a cross-sectional area of the associated charging carrier.

By feeding workpieces on the feed conveyor inside the furnace, the present reheat furnace utilizes an entrance end wall design that minimizes heat loss. The furnace charging machine of the invention does not move a workpiece from a location on a feed roll conveyor outside the furnace to the feed conveyor inside the furnace. Instead, the present furnace charger carriers normally extend through openings in the entrance end wall that approximate the cross-sectional area of the carriers, to transfer a workpiece from the in-furnace feed roll to the walking beam mechanism in the furnace.

In its broader aspects, the method of reheating metal workpieces of the present invention includes the step of feeding workpieces into a reheat furnace. The method includes conducting a step selected from the group consisting of transferring the workpieces beyond the buffer zone to the heating zone, and transferring the workpieces through the buffer zone and to the heating zone. The workpieces are transferred through the heating zone and removed from the furnace.

More particularly, the present method includes the steps of feeding the workpieces into the reheat furnace along the feed conveyor rollers in a direction of their length. The underside of the workpieces are each engaged with leading end portions of the charging carriers. The leading ends of the charging carriers are raised and lift each of the workpieces from the in-furnace feed conveyor rollers. The workpieces are transferred transverse to their length from the feed rollers to the walking beam mechanism in the buffer zone, in the event of a mill outage downstream of the reheat furnace. No heating devices are located in the buffer zone to apply direct heat to the workpieces in the buffer zone. The workpieces are transferred transverse to their length by the walking beam mechanism from the buffer zone into the heating zone. Direct heat can be applied to the workpieces from heating devices located in the heating zone. The workpieces are removed from the reheat furnace along the discharge rollers in a direction of their length.

Another embodiment of the invention is directed to a method of reheating metal workpieces in a reheat furnace located in a path for conveying workpieces between a continuous caster and a rolling mill, during operation of the caster and an outage of the rolling mill halting its operation, comprising the steps of:

(a) receiving a signal indicating outage of the rolling mill, (b) receiving workpieces from the caster into the reheat furnace, (c) transporting each of the workpieces to a buffer zone in the reheat furnace in response to the signal, the buffer zone having no heating devices for applying direct heat to the workpieces, (d) transporting the workpieces to a heating zone having heating devices that apply direct heat to the workpieces, and (e) repeating the steps (b) and (c) until the caster operation halts, the rolling mill operation restarts, or the buffer zone is filled with workpieces.

The workpieces may be advanced in the buffer zone during the rolling mill outage. Motion of the workpieces in the reheat furnace may be halted in response to the signal anticipating the duration of the rolling mill outage. Also, the heating temperature in the heating zone may be adjusted in response to the signal anticipating the duration of the rolling mill outage.

The invention will become better understood from the accompanying drawings and the detailed description of preferred embodiments.

DETAILED DESCRIPTION OF PREFERRED EMBODIMENTS

Figure 1:
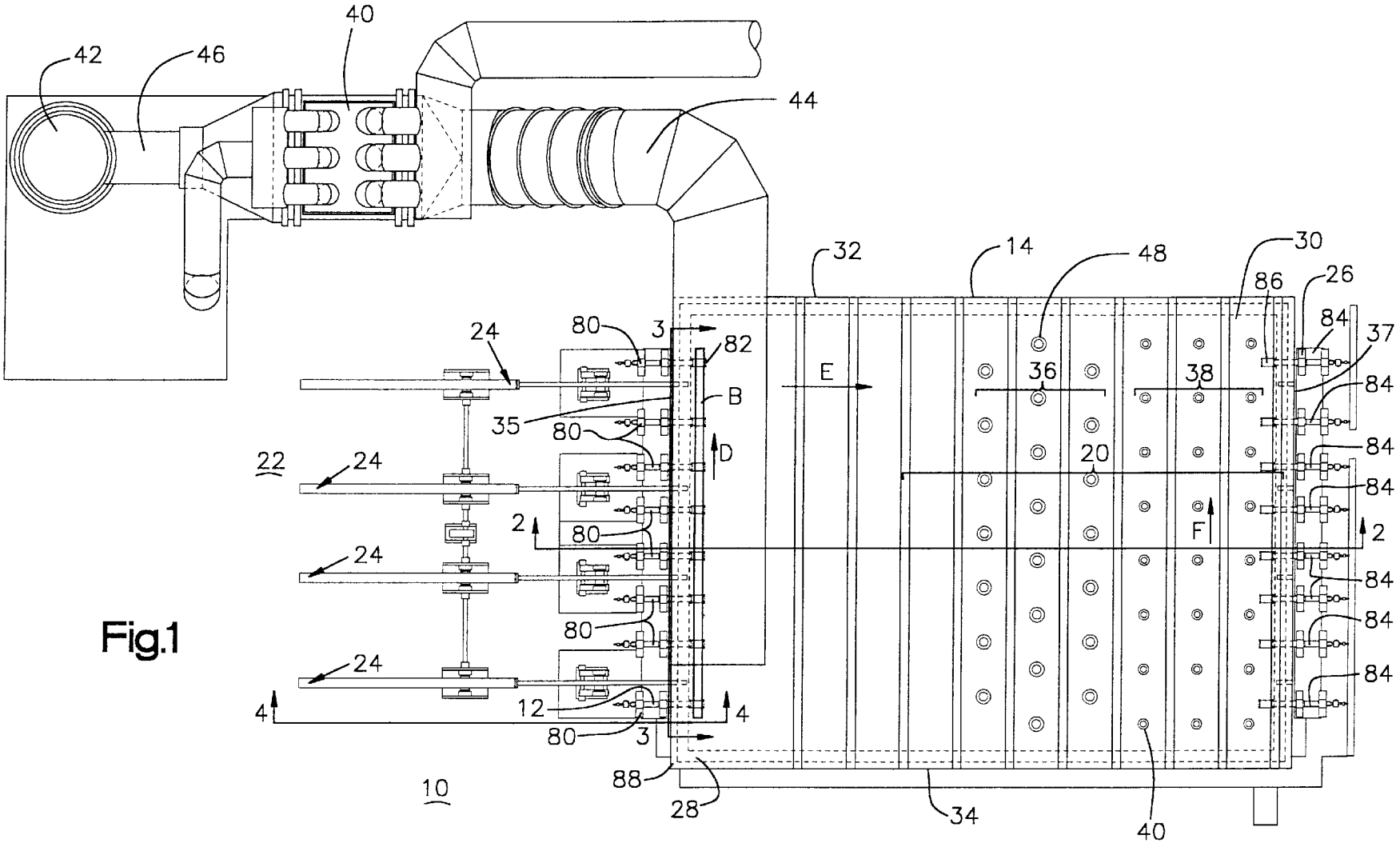
FIG. 1 is a top plan view of a reheat furnace and apparatus constructed in accordance with the present invention.
Figure 2:
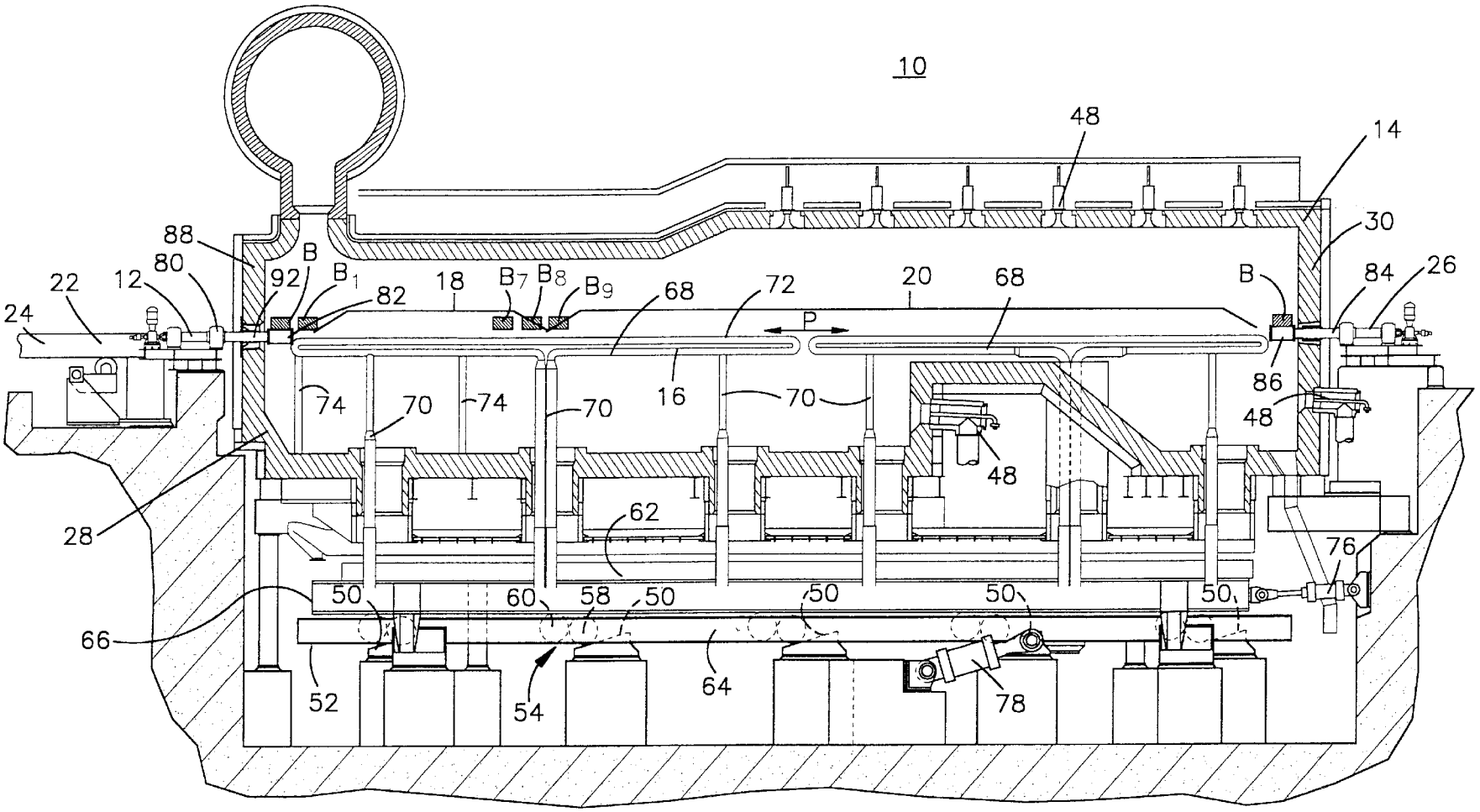
FIG. 2 is a partial sectional view of the reheat furnace and apparatus of FIG. 1, as seen from the plane designated by lines 2—2 shown in FIG. 1.
Figure 3:
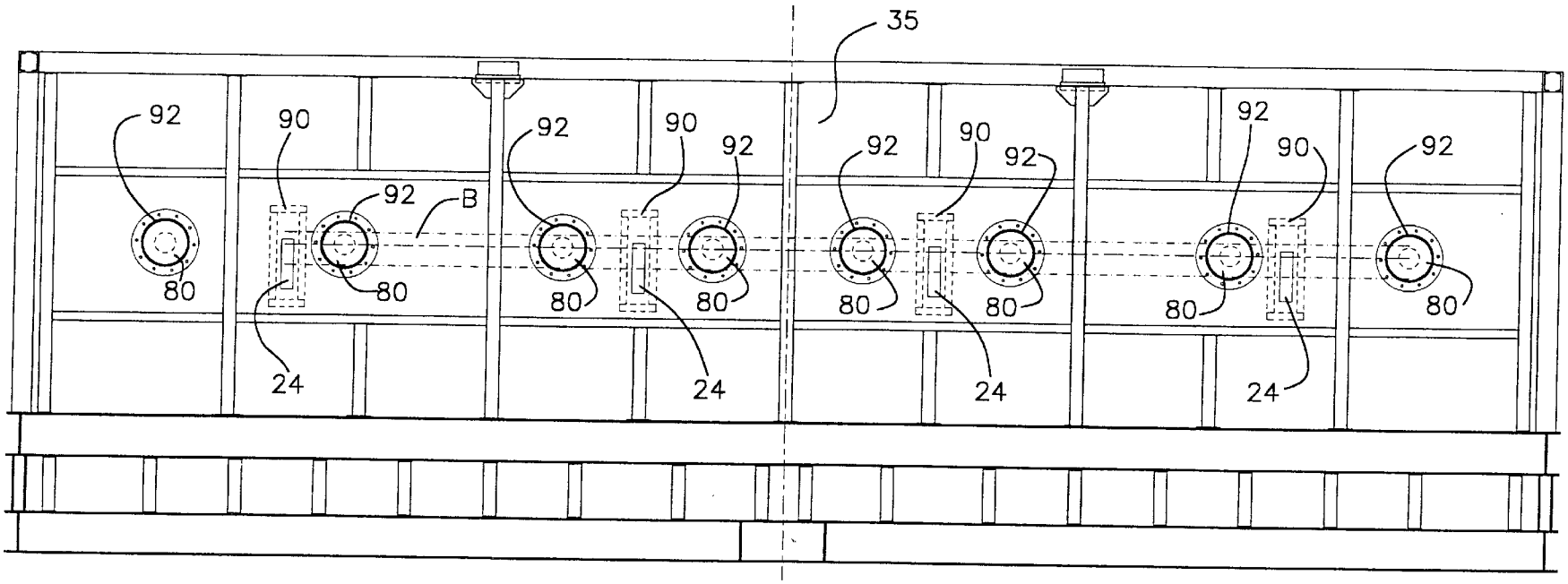
FIG. 3 is a front elevational view of a charge wall of the reheat furnace, as seen from the plane designated by lines 3—3 shown in FIG. 1.

Turning now to the drawings, and to FIGS. 1 and 2 in particular, the reheat furnace apparatus of the invention is shown generally at 10. The reheat furnace apparatus 10 is used to reheat elongated steel workpieces or blooms B having a substantially rectangular cross-section. An in-furnace feed conveyor 12 feeds the workpieces B into a reheat furnace 14 along a path D. A walking beam mechanism 16 conveys the workpieces B transverse to their length along the path E. The furnace 14 is constructed to have a buffer zone 18 having no heating devices therein, such as burners or the like, which would apply direct heat to the workpieces B. The furnace 14 is also constructed to have a heating zone 20 with heating devices such as burners that apply direct heat to the workpieces B. A charging mechanism 22 is provided having charging carriers 24 that transfer workpieces B transverse to their length to selected locations on the walking beam mechanism 16 in the buffer zone 18 or the heating zone 20. A discharge conveyor 26 discharges workpieces B out of the furnace along a path extending in a direction F.

The furnace 14 is a side charge and discharge furnace, constructed with an entrance end portion 28 and an exit end portion 30 opposite to the entrance end portion 28. Two side walls 32, 34 are spaced apart from each other and extend between the entrance and exit end portions 28, 30. The furnace has an entrance end wall or charge wall 35 and an exit end wall 37. The furnace 14 is preferably constructed to have the heating zone 20 located downstream from the buffer zone 18. The heating zone 20 is a multiple heating zone including a heating region 36 and a soak region 38. Ultra-low NOx burners 48 are arranged in a top and bottom fired configuration known in the art.

It should be appreciated that modifications to the reheat furnace by those skilled in the art are contemplated by the invention. For example, the reheat furnace could be an end charge and discharge furnace, the buffer and heating zones could be different sizes, and the buffer zone could be located downstream from the heating zone.

The primary variable in the combustion control systems used for the heating zone 20 is the temperature in the furnace 14. A secondary variable in the combustion control systems is the fuel-to-air ratio. These variables also determine furnace temperature regulation when the buffer zone 18 is utilized.

The buffer zone 18 may have any length, although a length sufficient to accommodate the width of eight blooms B is preferred. The first, fifth, seventh and ninth positions in the furnace beyond the feed conveyor ("$B_1$, $B_5$, $B_7$ and $B_9$") are shown in FIG. 2. The buffer zone includes positions $B_1$–$B_8$, the first position in the heating zone being $B_9$. In the buffer zone 18, although no direct heat is applied to the blooms B, the blooms B will not cool to ambient temperature. The blooms B are heated indirectly by excess radiation, convection, and conduction heat from the heating zone 20.

Blooms B are preferably hot charged into the furnace 14 from the caster. The charge and discharge temperatures will vary according to the grade of material and the production rate. The bloom tip-to-tail charge temperature may vary about 110 degrees F. The following Table 1 shows theoretical furnace performance during normal operation, the indicated production rates being when the buffer zone 18 is bypassed. The following fuel rates are short ton rates at test conditions with the furnace in a new condition and at thermal equilibrium.

TABLE 1

| | Case 1 | Case 2 | Case 3 | Case 4 | Case 5 |
|---|---|---|---|---|---|
| AISI Grade | 8,620 | 4,140 | 1,070 | 52,100 | 12xxx |
| Charge Temperature (°F.)(Avg.) | 1,290 | 1,290 | 1,380 | 1,380 | 1,380 |
| Discharge Temperature (°F.)(Avg.) | 1,995 | 1,995 | 1,890 | 1,920 | 2,190 |
| Maximum Temperature Differential (°F.)(Hot-Cold) | ±25 | ±25 | ±25 | ±25 | ±25 |
| Production Rate (tons/hour) | 180 | 180 | 180 | 180 | 180 |
| Fuel Rate (Million Btu/ton) | 0.55 | 0.55 | 0.47 | 0.5 | 0.62 |
| Scale Loss (%) | 0.65 | 0.65 | 0.65 | 0.65 | 0.65 |
| *$NO_x$ Emissions (pounds/Million Btu) | 0.09 | 0.09 | 0.09 | 0.09 | 0.09 |

The reheat furnace 14 includes other furnace components as is known to those skilled in the art, including a recuperator 40 for preheating combustion air, a positive draft ejector type stack 42, a flue 44, a damper 46, and all combustion control systems and necessary auxiliary systems. Combustion product gases exit the furnace 14 through the flue 44 above the feed conveyor 12. The gases then pass through a duct to the recuperator 40, damper 46 and ejector drive stack 42. The recuperator 40 preheats the combustion air to approximately 900 degrees F.

The combustion system is constructed in a manner known to those skilled in the art, and includes heaters or burners 48 disposed at locations in the furnace for applying direct heat in the heating region 36 and the soak region 38 of the heating zone 20. No burners are provided in the buffer zone 18 and no direct heat is applied to the blooms B in the buffer zone 18. In the heating region 36 direct heat is applied from the burners 48 to the blooms B located therein to raise the temperature of the blooms B to near the discharge temperature. In the soak region 38 direct heat is applied from the burners 48 to blooms B located therein to equalize the blooms B at their discharge temperature prior to exiting the furnace 14. Combustion control systems are used for providing the desired heat in the heating and soak regions 36, 38.

The fuel that is used is natural gas with a minimum net heating value of 1000 Btu/SCF supplied to the furnace at a minimum pressure of 40 psi. Firing is performed with 900° F. combustion air. The blooms B are preferably 10 inches by 13 inches by 40 feet, although the bloom dimensions may vary. The blooms B range from 19 feet to 46 feet in length.

When the buffer zone 18 is used, the walking beam conveyor 16 transfers the workpieces B from the furnace entrance end portion 28 to its exit end portion 30, during which the workpieces B pass through the buffer zone 18, the heating region 36 and the soak region 38. As shown in FIG. 2, the walking beam conveyor 16 includes inclined ramps 50. An intermediate lift frame structure 52 contains wheel assemblies 54 arranged in a two wheel system group. Each upper wheel 60 of a group is mounted on a different shaft at a different height than each lower wheel 58 of the group. The lower wheels 58 ride on the ramps 50, while the upper wheels 60 support a main frame structure 62. The intermediate lift frame 52 includes an intermediate frame beam 64. The main frame 62 includes a main frame beam 66. The main frame beam 66 supports movable horizontal skids 68 above the beam on posts 70. The intermediate frame beam 64 supports a fixed skid 72 on posts 74. The blooms B in the furnace 14 are supported on their bottom surface by fixed skids 72, except when being moved by the walking beam, when they are supported by the movable skids 68. The movable and fixed skids 68, 72 are water cooled.

A hydraulic cylinder 76 is connected to the main frame beam 66 and moves it longitudinally upon the upper wheels 60, toward and away from the furnace exit end portion 30. A hydraulic cylinder 78 is connected to the intermediate frame beam 64 and moves it up and down the ramps 50 upon the lift wheels 58. When the intermediate frame beam 64 is moved by the cylinder 78, the upper wheels 60 roll underneath the main frame beam 66, while the lower wheels 58 roll up or down the associated ramps 50. As a result, the main frame beam 66 is moved vertically, i.e., lifted or lowered, while remaining at a fixed longitudinal location, unless moved independently by the cylinder 76 to advance the workpieces B supported on the movable skids 68 toward the furnace exit 30. By moving the main frame beam in the opposite direction, the cylinder 76 also moves the movable skids 68 back to the home position. During normal operation, the walking beam conveyor 16 cycles the blooms B through the furnace heating zone 20 at a selected travel rate. During a rolling mill outage the walking beam conveyor 16 either cycles the blooms B through the buffer zone 18 and the heating zone 20 or holds the blooms B in position in the furnace 14.

The cycle of walking beam movement consists of five strokes. In the first stroke, the cylinder 78 moves the intermediate frame beam 64 on the lower wheels 58 up the inclined ramps 50 while the main frame beam 66 remains in the horizontally fixed home position shown in FIG. 2. This raises the movable skids 68 vertically, from a workpiece pass line P to four inches above the workpiece pass line P, lifting the blooms from the fixed skids 72. In the second stroke, the cylinder 76 moves the main frame beam 66 horizontally approximately eighteen inches on the upper wheels 60 while the intermediate frame beam 64 is in the raised position. In the third stroke, the cylinder 78 moves the intermediate frame beam 64 downward, while the main frame beam 66 remains extended at a horizontally fixed position. This vertically lowers the intermediate frame beam 64 and the movable skids 68 through the pass line P to a vertical position four inches below the pass line P, and the blooms are again supported on the fixed skids 72, but at a horizontally advanced location toward the exit portion of the furnace. In the fourth stroke the transverse cylinder 76 moves the main frame beam 66 horizontally eighteen inches back to the home position while the intermediate frame beam 64 is in the lower position. Finally, in the fifth stroke the cylinder 78 moves the intermediate frame beam 64 on the wheels 58 along the ramps 50 to raise the movable skids 68 four inches to the home position at the pass line P. The total walking beam cycle lasts approximately 45 seconds. Normally, blooms B travel through the reheat furnace at a rate of 16–20 blooms/hour.

The furnace entrance end portion 28 includes a charge wall 35 extending between the side walls 32, 34. The wall 35 has openings 90 each corresponding to an associated charging carrier 24 and having a size approximating a cross-sectional area of the associated charging carrier 24. The carriers 24 are movable within the openings 90 to move workpieces B from the in-furnace feed conveyor 12 to the walking beam mechanism 16. By designing the charge wall 35 with the openings 90 having a cross-sectional opening slightly larger than the cross-sectional area of each charging carrier 24, the carriers 24 can move the workpieces B within the furnace with minimal heat loss from the furnace. Openings 92 are also provided in the charge wall 35, offset from the openings 90, to accommodate the feed roll assemblies 80. The openings 92 permit the drives for the feed roll assemblies 80 to be located outside the furnace and insulated from the furnace by the wall 35.

The feed conveyor 12 extends into the furnace entrance end portion 28 from the side wall 32 to the side wall 34. The feed conveyor 12 includes a plurality of the driven roll assemblies 80. Each of the roll assemblies 80 has the drive mechanism located outside the furnace 14 and driven rollers 82 located within the furnace 14. The rollers 82 are water cooled.

Blooms B travel into the furnace 14 on the feed rollers 82 along the path D. The discharge conveyor 26 is located at the furnace exit end portion 30 and extends from the side wall 32 to the side wall 34. The discharge feed conveyor 26 includes a plurality of roll assemblies 84 each having a drive mechanism located outside the furnace 14 and driven rollers 86 located within the furnace 14. The roll assemblies 84 extend through openings similar to those in the charge wall 35. The rollers 86 are water cooled. Blooms B travel out of the furnace 14 on the discharge rollers 86 along the path F. The rollers 82, 86 are made from a high temperature steel alloy. Each of the roll assemblies 80, 84 is independently driven by a 7.5 horsepower motor reducer assembly, designed to move the blooms B at about 300 feet per minute.

The furnace charging machine 22 preferably includes four horizontal charging carriers 24 each having a first end portion 94 and a second workpiece engaging end portion 96. Each of the carriers 24 is made from rolled steel plate. Each charging carrier 24 extends between successive drive roll assemblies 80. The stationary driving mechanisms 100 are each adapted to drive an associated one of the charging carriers 24 between an extended position within the furnace 14 and a retracted position away from the furnace 14.

Each of the carriers 24 preferably has a rectangular cross section and a lower surface 104, although the carriers 24 are not limited to any particular cross-sectional shape. Each driving mechanism 100 includes a frame 106 and the driving pinion 108 rotatably connected to the frame 106. The pinion 108 has a plurality of teeth 110 along its peripheral surface. The rack 112 is disposed along a portion of the length of the carriers 24 at their lower surface 104. The rack 112 has teeth 114 that correspond to and mesh with the pinion teeth 110.

Activating a motor drives the pinions 108 to drive the carriers 24, either toward the furnace 14 or away from the furnace 14. A hold down roller 118 is mounted to the frame 106 to ensure that the rack 112 and pinion 108 of each of the carriers 24 are engaged regardless of the position of the carrier 24.

Figure 4:
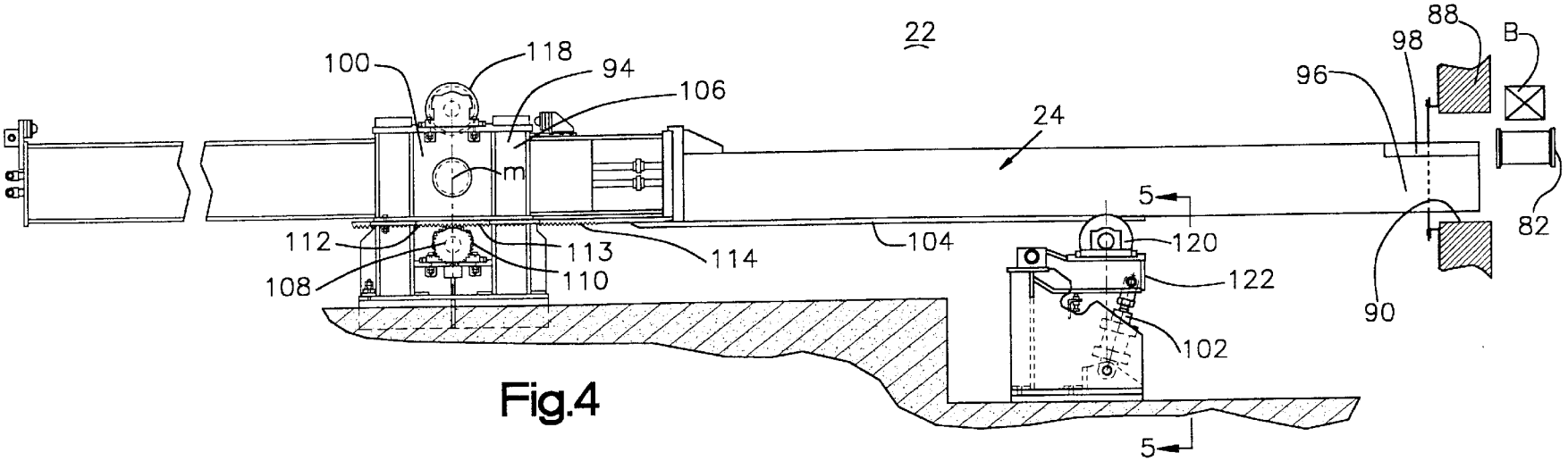
FIG. 4 is a partial elevational view of a charging machine constructed in accordance with the invention, as seen from the plane designated by lines 4—4 shown in FIG. 1.
Figure 5:
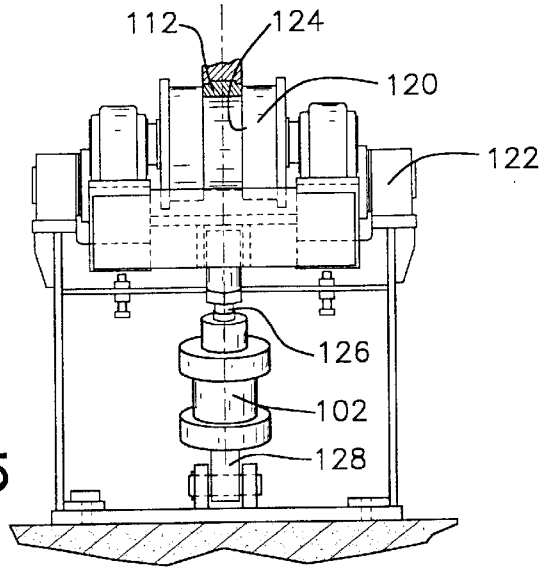
FIG. 5 is an elevational view of an apparatus for raising a charging machine carrier, as seen from the plane designated by lines 5—5 shown in FIG. 4.

Hydraulic cylinders 102 vertically move the second end portions 96 of the charging carriers 24. This permits the carriers 24 to lift a bloom B from the rollers 82 and, after the carriers 24 are extended into the furnace, to lower the bloom B onto the walking beam conveyor 16. As shown in FIGS. 4 and 5, the vertical movement of the carriers 24 caused by the hydraulic cylinders 102 is effected by an apparatus that includes the roller 120 rotatably connected to a frame 122. Each roller 120 has a peripheral groove 124 for receiving the rack 112. Each cylinder 102 has a piston 126 connected to the frame 122. The cylinder 102 has a lower end 128 that is pivotably movable. By extending the piston 126, the carrier 24 is raised to a predetermined height. The carrier 24 is lowered by retracting the piston 126 into the cylinder 102.

The furnace charger 22 moves its carriers 24 in a five step cycle, during which it charges a bloom B either directly into the heating zone 20 during normal furnace operation, or into the buffer zone 18 in the event of a rolling mill outage. The carriers 24 begin in a rearward home position shown in FIG.

4. In the first step, each pinion 108 is rotated in a direction toward the furnace 14 and moves the carriers 24 horizontally from the home position to a pick up position between successive feed roll assemblies 80 in the furnace 14 and below a bloom B to be charged. In the second step, the cylinders 102 are actuated and the pistons 126 extended to vertically raise the carriers 24.

In the third step, if a signal is sent to the furnace charger 22 indicating a rolling mill outage, the pinions 108 are driven to horizontally move the carriers 24 to a deposit position above the next available position furthest into the furnace in any one of the eight locations in the buffer zone 18. During normal operation, the third step consists of advancing the carriers 24 into the furnace 14 directly to a ninth furnace deposit position $B_9$ (i.e., the first position in the heating zone 20), located approximately 18 feet from the furnace entrance end 28.

In the fourth step, the pistons 126 are retracted into their associated cylinders 102 to vertically lower the charging carriers 24 below the fixed and movable skids 72, 68, to deposit the bloom on the fixed and movable skids 72, 68 in one of the eight buffer zone 18 locations or in the ninth furnace position $B_9$. In the fifth step, the pinions 108 are rotated in the opposite direction away from the furnace 14 to substantially horizontally retract the carriers 24 from the furnace 14 back to the home position. The total furnace charging cycle lasts approximately 40 seconds.

The reheat furnace apparatus includes a processor that electrically communicates with a hydraulic valve that either energizes or deenergizes a hydraulic motor associated with the pinions of the driving mechanism and sensing devices at least at the caster and the rolling mill. The processor is programmed to accomplish the following functions.

During normal operation of the reheat furnace apparatus 10 the caster and the rolling mill are operating within normal production parameters. Blooms B are fed from the caster into the furnace 14 by the feed conveyor 12 in a direction of their length. The furnace charger 22 is activated to raise a bloom B from the in-furnace feed conveyor rollers 82 and transfer it transversely beyond the buffer zone 18 to the ninth furnace position $B_9$ in the heating region 36 of the heating zone 20 on the fixed and movable skids 72, 68. The buffer zone is empty during normal operation. The bloom B is advanced through the furnace 14 toward the exit end portion 30 by cycling of the walking beam conveyor 16. During each cycle, the bloom B is lifted above the bloom pass line P and moved horizontally to a location approximately eighteen inches advanced from the prior location. In this manner the bloom B is transported step-wise through the heating and soak regions 36, 38 and onto the discharge conveyor rollers 86, on which the bloom B is transported out of the furnace 14 in a direction of its length. The bloom B is then transported to the rolling mill.

The operation of the reheat furnace apparatus 10 during a scheduled or unscheduled rolling mill outage while the caster continues to operate requires use of the buffer zone 18. The buffer zone 18 is used only when a production "buffer" is required between the casting operation and rolling mill operation and is required for emergency or metallurgical purposes. The reheat furnace 14 continues to receive blooms B from the caster but will not discharge any blooms B from the furnace 14 to the rolling mill. This condition continues until the mill restarts or the buffer zone 18 is filled with blooms B. When the buffer zone is filled with blooms the processor may halt the walking beam motion and adjusts the combustion system in accordance with the estimated delay time and bloom temperature requirements.

More specifically, during a rolling mill outage while the caster continues to operate, blooms B are fed from the caster into the furnace 14 by the feed conveyor 12 in a direction of their length. In response to signals received from a sensing device at the rolling mill indicating an outage there, the processor sends a control signal to the hydraulic valve and the hydraulic motor. This control signal activates the motor to rotate the drive pinions and advance the carriers a desired distance to deposit blooms in the buffer zone of the furnace. The control signal rotates the pinions and activates the furnace charger piston to raise a bloom B from the feed conveyor rollers 82 and transfer it transversely on the fixed and movable skids 72, 68 to the last available buffer zone location farthest in the furnace 14.

The walking beam 16 either cycles the blooms B through the furnace 14 or holds them in position during a rolling mill outage. The walking beam conveyor rate may be increased to empty the buffer zone when the processor detects that the buffer zone is nearly filled, such as when a bloom is placed in the fifth position $B_5$ in the buffer zone. When the buffer zone 18 is filled, the caster operation is preferably adjusted to cease conveying blooms B to the reheat furnace 14. The walking beam conveyor may either have its rate increased if there is room available in the heating zone or it may be stopped if no room is available in the heating zone. The combustion system either heats the blooms B to the specified temperature or holds them at temperature, depending on the particular operating conditions. The reheat furnace 14 thus operates to maintain heat in the blooms B and control the parameters to insure that the blooms B have good metallurgical quality by not allowing blooms to be backlogged between the reheat furnace and the rolling mill. The processor is adapted to control furnace conditions such as temperature and gas flow of the furnace. Upon receiving signals from sensing devices indicating that the rolling mill has restarted, the processor may increase the rate at which the walking beam conveys the blooms through the furnace to empty the buffer. The heating rate of the furnace is also increased simultaneously.

The furnace 14 is also capable of a cold charge operation when the caster is out of service. During the cold charge operation the reheat furnace operates at a much slower rate than normal, consistent with metallurgical and production requirements.

While particular embodiments of the present invention have been illustrated and described herein, they are not intended to limit the invention to such disclosures and changes and modifications may be made thereto within the scope of the following claims.

We claim:

1. Reheat furnace apparatus for reheating elongated metal workpieces, comprising:

a reheat furnace comprising an entrance end portion and an exit end portion, a buffer zone that temporarily contains workpieces during a backup operation without applying direct heat to the workpieces, and a heating zone in which direct heat is applied to the workpieces, a conveyor for moving the workpieces through the furnace to the exit end portion, charging means for moving the workpieces in the furnace during normal operation through said buffer zone without the workpiece residing therein and directly into said heating zone and for moving the workpiece in the furnace during a backup operation into said buffer zone, and means for directing said charging means to selectively deposit workplace in said heating zone during said normal operation and in said buffer zone during said backup operation.

2. The reheat furnace apparatus according to claim 1 wherein said buffer zone has a length effective to prevent workpieces placed in said buffer zone from entering said heating zone during a delay downstream of said reheat furnace.

3. The reheat furnace apparatus according to claim 2 wherein said reheat furnace has a length which exceeds a normal reheat furnace length by the length of said buffer zone.

4. Reheat furnace apparatus for reheating elongated metal workpieces comprising a reheat furnace comprising an entrance end portion, an exit end portion, two side walls spaced apart from each other and extending between the entrance end portion and the exit end portion, a buffer zone that temporarily contains workpieces during a backup operation without burners applying direct heat to the workpieces and a heating zone disposed downstream of said buffer zone, at least one burner that applies direct heat to the workpieces in said heating zone, at least one feed mechanism that foods the workpieces near the furnace entrance end portion, at least one conveyor mechanism that conveys the workpieces from the entrance end portion to the exit end portion, at least one charging mechanism that transfers the workpieces from the feed mechanism into the furnace during normal operation through said buffer zone without the workpieces residing therein and directly on the conveyor mechanism in said heating zone and moves the workpieces in the furnace during a backup operation onto the conveyor, in said buffer zone, means for directing said charging mechanism to selectively deposit workpieces in said heating zone during said normal operation and in said buffer zone during said backup operation, and a discharge mechanism that discharges the workpieces from the furnace.

5. The reheat furnace apparatus according to claim 3 wherein the feed mechanism and the discharge mechanism each comprises a conveyor having driven rollers within the reheat furnace for feeding workpieces in a direction of their length from one side wall toward the other.

6. The reheat furnace apparatus according to claim 3 further comprising a wall at the entrance end portion extending between the side walls, said wall having openings each corresponding to an associated charging mechanism and having a size approximating a cross-sectional area of said associated charging mechanism.

7. A furnace charging machine for charging elongated metal workpieces into a reheat furnace, the reheat furnace including a buffer zone adapted to temporarily contain the workpieces without direct heat being applied to the workpieces and a heating zone in which direct heat is applied to the workpieces, comprising elongated, substantially horizontal carriers each having a workpiece engaging end that engages the underside of a workpiece, wherein said carriers are adapted to be movable along a path at least a portion of which is within the furnace and travel along the path from a location where said carriers receive a workpiece, through said buffer zone without the workpieces residing therein and directly to a location in the heating zone where said carriers deposit the workpiece normally, and said carriers being adapted to travel along the path to selected locations in the buffer zone during a backup operation, actuators each for vertically moving the workpiece engaging end of an associated charging carrier, stationary driving mechanisms each adapted to drive an associated one of said carriers along said path, and means for directing said actuators and said driving mechanisms to selectively deposit workpieces in said heating zone during said normal operation and in said buffer zone during said backup operation.

8. Reheat furnace apparatus for reheating elongated metal workpieces, comprising:

a reheat furnace comprising an entrance end portion and an exit end portion, a buffer zone that temporarily contains workpieces during a backup operation without direct heat being applied to the workpieces, and a heating zone in which direct heat is applied to the workpieces, means for feeding workpieces near the entrance end portion, conveyor means for moving the workpieces from the entrance end portion to the exit end portion, charging means for moving the workpieces in the furnace during normal operation through said buffer zone without the workpieces residing therein and directly into said heating zone and for moving the workpieces in the furnace during a backup operation into said buffer zone, means for directing said charging means to selectively deposit workpieces in said heating zone during said normal operation and in said buffer zone during said backup operation, and means for removing the workpieces from the furnace through the exit end portion.

9. A method of reheating metal workpieces in a reheat furnace, comprising the steps of:

(a) feeding workpieces near an entrance end portion of a reheat furnace, the reheat furnace comprising a buffer zone in which no burners apply direct heat to the workpieces and a heating zone in which at least one burner applies direct heat to the workpieces;

(b) moving workpieces in the furnace during normal operation through said buffer zone without the workpieces residing therein and directly into said hearing zone and moving the workpieces in the furnace during a backup operation into said buffer zone, (c) directing said charging means to selectively deposit workpieces in said heating zone during said normal operation and in said buffer zone during said backup operation; and (d) discharging workpieces from the furnace.

10. The method according to claim 9 comprising feeding the workpieces into the furnace along feed rollers located within the furnace.

11. The method according to claim 9 wherein the reheat furnace is located in a path for conveying workpieces between a continuous caster and a rolling mill, said method further comprising the steps of;

(i) receiving a signal indicating outage of the rolling mill, (ii) receiving workpieces from the caster into the reheat furnace, (iii) transporting each of the workpieces to said buffer zone in response to said signal, (iv) transporting the workpieces to said heating zone, and (v) repeating said steps i and ii until operation of the caster halts, operation of the rolling mill restarts, or the buffer zone is filled with workpieces.

12. The method according to claim 11 further comprising the step of adjusting heating conditions in the heating zone in response to a signal anticipating the duration of the rolling mill outage.

13. The method according to claim 9 further comprising the step of halting motion of the workpieces in the reheat furnace.

14. A furnace charging machine for charging elongated metal workpieces into a reheat furnace, the reheat furnace including a buffer zone adapted to temporarily contain the workpieces without direct heat being applied to the workpieces and a heating zone in which direct heat is applied to the workpieces, comprising elongated, substantially horizontal carriers each having a workpiece engaging end that engages the underside of a workpiece, each of said carriers having a length effective to enable said workpiece engaging end to reach the heating zone, wherein said carries moves the workpieces in the furnace during normal operation through said buffer zone without the workpieces residing therein and directly into said heating zone and move the workpieces in the furnace during a backup operation into said buffer zone, actuators which each vertically move the workpiece engaging end of an associated charging carrier, stationary driving mechanisms which each drive an associated one of said carriers generally horizontally, and a processor that sends electrical signals which are effective to cause said actuators and said driving mechanisms to selectively deposit workpieces in said heating zone during said normal operation and in said buffer zone during said backup operation.

15. Reheat furnace apparatus for reheating elongated metal workpieces, comprising:

a reheat furnace comprising an entrance end portion and an exit end portion, a buffer zone that temporarily contains workpieces during a backup operation without applying direct heat to the workpieces, and a heating zone in which direct heat is applied to the workpieces, a conveyor for moving the workpieces through the furnace to the exit end portion, at least one charging mechanism that moves the workpieces in the furnace during normal operation through said buffer zone without the workpieces residing therein and directly into said heating zone and moves the workpieces in the furnace during a backup operation into said buffer zone, and a processor that sends electrical signals effective to enable said charging mechanism to selectively deposit workpieces in said heating zone during said normal operation and in said buffer zone during said backup operation.

* * * * *